US006456207B1

(12) United States Patent
Yen

(10) Patent No.: US 6,456,207 B1
(45) Date of Patent: Sep. 24, 2002

(54) INTELLIGENT TAXI TOTAL SERVICE SYSTEM

(76) Inventor: John Yen, 9F-5, No. 12, Chung-Hwa Rd., Young-Kang City, Tainan Hsien (TW)

( * ) Notice: Subject to any disclaimer, the term of this patent is extended or adjusted under 35 U.S.C. 154(b) by 0 days.

(21) Appl. No.: 09/788,960

(22) Filed: Feb. 20, 2001

(51) Int. Cl.[7] ..... G08G 1/123

(52) U.S. Cl. ..... 340/994; 235/384; 340/434; 340/988; 340/995; 705/13

(58) Field of Search ..... 340/434, 988, 340/995, 994, 905; 701/209; 235/384; 455/456; 705/13

(56) References Cited

U.S. PATENT DOCUMENTS 4,259,664 A * 3/1981 Boisclair ..... 340/539
5,168,451 A * 12/1992 Bolger ..... 340/994
5,182,555 A * 1/1993 Sumner ..... 340/905
5,684,860 A * 11/1997 Milani et al.
5,726,885 A * 3/1998 Klein et al. ..... 235/384
5,945,919 A * 8/1999 Trask ..... 235/384
5,973,619 A * 10/1999 Paredes ..... 340/994
6,108,554 A * 8/2000 Kawamoto ..... 455/456

* cited by examiner

*Primary Examiner*—Brent A. Swarthout

(57) ABSTRACT

The present invention relates to an intelligent taxi total service system having an intelligent automatic management system, which provides automation functions such as inquiring, broadcasting positioning, tracing, recording, searching, confirming, charging, receipt printing, navigating, real time traffic information, security, emergency help requesting and communication, so as to achieve a total service system with efficacy of high security, high reliability, and time saving.

3 Claims, 1 Drawing Sheet

INTELLIGENT TAXI TOTAL SERVICE SYSTEM

FIELD OF THE INVENTION

The present invention relates to an intelligent taxi total service system and more particularly, to an intelligent taxi total service system having an intelligent automatic management system, which provides automation functions such as inquiring, broadcasting, positioning, tracing, recording, searching, confirming, charging, receipt printing, navigating, real time traffic information, security, emergency help requesting and communication, so as to achieve a total service system with efficacy of high security, high reliability, and time saving.

BACKGROUND ART

Generally, taxi is one of most popular and most convenient public transportation means at present. Since the flexibility of working hour and easiness of obtaining professional operator's license, taxi driving is actually the easiest way of earning a living at present. Hence, one can readily imagine the number of people currently involved in this job. However, due to the diversified qualities of taxi drivers, it is still hard to effectively curb crime committed by the utilization of taxi, despite the reorganization efforts made by the government with great exertion. According to statistics from Ministry of the Interior (of R. O. C.), there are numerous taxi-related incidents such as taxi driver being robbed, female passenger being violently harassed and assaulted as well as careless passenger leaving objects on taxi, etc.

Conventionally, although taxi service system has covered many fields, it is inconvenient in that such system cannot provide to all parties with automatic total service. As for defense (robbery prevention) measures, the system provides only one-way protection such as preventing driver from being robbed or preventing passenger from being assaulted by the driver. When receiving a taxi service call, the taxi service center can only passively provides information to either taxi driver or passenger via paging or recording instead of actively provide to both parties with necessary information. Therefore, it is necessary to provide a safe and total taxi service system comprising:

(1) A passenger can call for a service from either a stationary residence or a non-stationary location.
(2) The service center can automatically check a location and operation status (occupied, vacant or off duty) of subordinate taxis at any time.
(3) The service center can permanently preserve a record of passenger and a route on subordinate taxis if necessary.
(4) In case of assault, the passenger can instantly transmit an emergency signal to the service center or the public security unit without going through the taxi.
(5) In case of robbery, vehicle failure, or other emergency, the taxi driver can instantly send a message to the service center or the public security unit and request for help.
(6) The taxi can use a satellite navigation device to calculate a distance and direct itself to its destination.
(7) The taxi can be informed of real time traffic information to avoid routes with heavy traffic.
(8) The invention can automatically print a receipt or an invoice.
(9) The invention can print a driving route for passenger if necessary.
(10) The passenger can rapidly trace and retrieve lost objects.

SUMMARY OF THE INVENTION

Therefore, an object of present invention is to provide an intelligent taxi total service system having an intelligent automation management system, which provides automation functions such as inquiring, broadcasting, positioning, tracing, recording, searching, confirming, charging, receipt printing, navigating, real time traffic information, security, emergency help requesting and communication.

To achieve above object, accordance to one aspect of present invention, it is provided an intelligent taxi total service system for a customer from either a stationary residence or a non-stationary location, comprises the following steps:

(1) the customer can use an exclusive paging device provided by a taxi service center to send a message through phone line by pushing a button on the paging device to display the a information (name or identification number, address and phone number) on a remote computer monitor of said taxi service center, through a satellite navigation system, a directing management system will then automatically show the status of nearby subordinate taxis, in which a red symbol indicates occupied, a blue symbol indicates off-duty, and a green indicates vacant;
(2) an automatic editing decode function of said directing management system will convert said message of service call into Chinese, and broadcast through a frequency modulation (FM) subcarrier transmitting station, and display said message on a LCD display screen in taxi to ask for a taxi willing to pickup the customer, upon receiving the response from a taxi, said directing management system will automatically send a taxi's basic information (registration number and model of the vehicle and driver's name) as well as a pickup time to the paging device on the customer-side through a cable or radio transmitting system;
(3) once a meter is turned on in the taxi after the pickup of the customer, an electronic map of said service center then instantly react and indicate that said taxi is occupied;
(4) after being notified with the destination, the taxi driver can use a satellite navigation function to calculate a preferred driving route and an estimated arrival time;
(5) said service center automatically records the locations and times of pickup and drop-off in a file;
(6) said service center permanently store the operation track of all its subordinate taxis;
(7) the taxi driver can print a receipt for the customer at drop-off, at the same time said service center will again indicate said taxi as vacant; and
(8) when the taxi driver wants to be off duty, all he need to do is to push a button in the taxi such that the computer monitor of said service center will indicate an off-duty status of his car.

Accordance to another aspect of present invention, there is provided an intelligent taxi total service system for a customer having a mobile phone, comprising the following steps:

(1) the customer can use an intelligent card to send a message to a taxi service center through a mobile phone to display a basic information (name or identification number, address and phone number) on a remote computer monitor of said taxi service center, which will then search for a currently available taxi nearby through a satellite navigation system;
(2) an automatic editing decode function of said directing management system will convert said message of service call into Chinese, and broadcast through a FM sub-carrier transmitting station, and display said message on a LCD display screen in taxis to ask for a taxi willing to pickup the customer, upon receiving the response from a taxi, said directing management system will automatically send a taxi's basic information (registration number and model of the vehicle and driver's name) as well as a pickup time to the customer's mobile phone through a voice mail or a message;

(3) once a meter is turned on in the taxi after the pickup of the customer, an electronic map of said service center then instantly react and indicate that said taxi is occupied;

(4) after being notified with a destination, the taxi driver can use a satellite navigation function to calculate a preferred driving route and an estimated arrival time;

(5) said service center automatically records the locations and times of pickup and drop-off in a file;

(6) said service center permanently stores the operation track of all its subordinate taxis;

(7) the taxi driver can print a receipt for the customer at drop-off, at the same time said service center will again indicate said taxi as vacant; and (8) when the taxi driver wants to be off duty, all he need to do is to push a button in the taxi such that the computer monitor of said service center will indicate an off-duty status of his car.

Accordance to yet another aspect of present invention, there is provided an intelligent taxi total service system for a customer having a Chinese language pager, comprising the following steps:

(1) the customer can use an intelligent card to dial a toll free number through a public phone and follow the voice instruction to display the basic information (name or identification number, address and phone number) on a remote computer monitor of said taxi service center, which will then search for a currently available taxi nearby through a satellite navigation system;

(2) an automatic editing decode function of said directing management system will convert said message of service call into Chinese language, and broadcast through a FM sub-carrier transmitting station, so as to display said message on a LCD display screen in taxi to ask for a taxi that willing to pickup the customer, upon receiving the response from a taxi, said directing management system will automatically send a taxi's basic information (registration number and model of the vehicle and driver's name) as well as a pickup time to the customer's mobile phone through a voice mail or a message;

(3) once a meter is turned on in the taxi after the pickup of the customer, an electronic map of said service center then instantly react and indicate that said taxi is occupied;

(4) after being notified with a destination, the taxi driver can use a satellite navigation function to calculate a preferred driving route and an estimated arrival time;

(5) said service center automatically records the locations and times of pickup and drop-off in a file;

(6) said service center permanently stores the operation track of all its subordinate taxis;

(7) the taxi driver can print a receipt for the customer at drop-off, at the same time said service center will again indicate said taxi as vacant; and (8) when the taxi driver wants to be off duty, all he need to do is to push a button in the taxi such that the computer monitor of said service center will indicate an off-duty status of his taxi.

To achieve above aspects, the present invention provides an intelligent taxi total service system, which comprises:

a customer-side setup, including a phone set with a paging device, an intelligent card, a mobile phone with the intelligent card, and a Chinese language pager, wherein said paging device and said intelligent card are provided by a taxi service center;

an on-taxi device, including a satellite positioning vehicle navigator, a satellite positioning track-tracing recorder, a FM sub-carrier receiver, a taxi radio receiving/transmitting device, mobile communication device, and a vehicle robbery prevention security device;

a device, used in taxi service center, including a CPU(central process unit), a synthetic interface, a terminal receiving/transmitting interface, a multi-frequency phone receiving/transmitting interface, an electronic map, a confirming device, a FM sub-carrier transmitter, a satellite positioning vehicle monitoring device, a satellite track-tracing route record preserving device, a satellite navigator; and a FM broadcasting device, including a schedule arrangement operating device and a FM sub-carrier modulator.

BRIEF DESCRIPTION OF DRAWINGS

The above and other objects, features, and advantages of present invention will become more apparent from the detailed description in conjunction with the following drawings, in which.

DETAILED DESCRIPTION OF THE INVENTION

Figure 1:
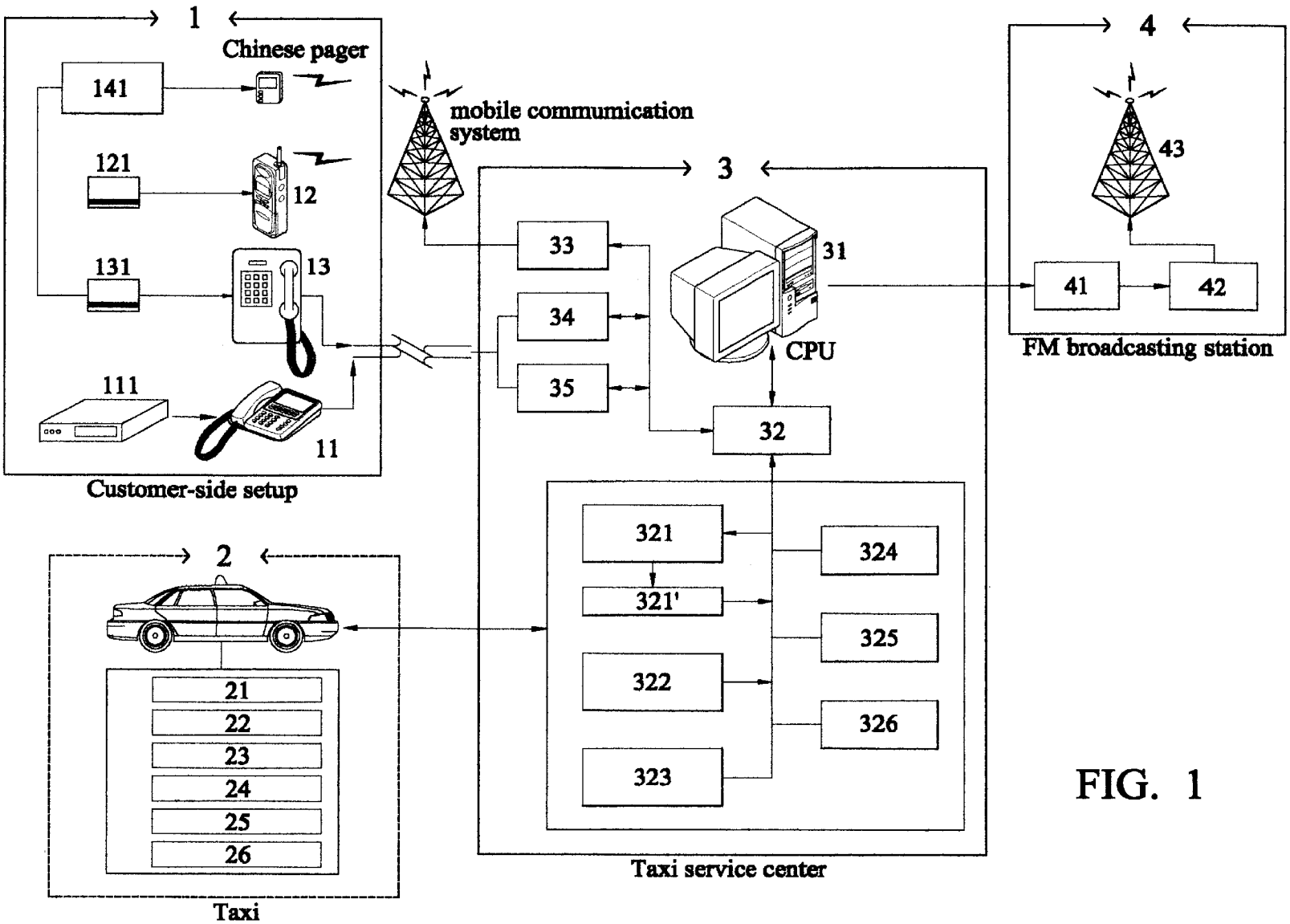
FIG. 1 is a block diagram showing a configuration of an intelligent taxi total service system in accordance with the present invention.

FIG. 1 is a block diagram showing a configuration of an intelligent taxi total service system in accordance with the present invention. FIG. 1, the customer 1 can call for a taxi 2 service by sending a message from a stationary location such as a residence or office to a taxi service center 3. Said message is sent via a phone 11 at customer 1 by pushing a button on the exclusive paging device 111 provided by the taxi service center 3; via a mobile phone 12 by using an intelligent card 121; or via a toll free call from a public phone 13 by using a pre-paid intelligent card 131. The basic information of the customer (name or identification number, address and phone number) is then displayed on a remote computer monitor 31 of said taxi service center 3, which will then search for a currently available taxi nearby from an electronic map 321 through a satellite positioning vehicle monitoring device 324. The CPU 31 and synthetic interface 32 of said taxi service center 3 will automatically edit and decode the message through the schedule arrangement operating device 41 and the FM sub-carrier modulator 42 of a FM broadcasting station 4. The FM sub-carrier transmitter 43 will display the customer's message on the LCD display screen in the taxi 2 in the form of Chinese language 23, or 24 (and/or 321') to ask for a taxi is willing to pickup the customer. Upon receiving the response from taxi driver, said taxi service center 3 will automatically sent the taxi's basic information (registration number and model of the vehicle and driver's name or ID) as well as the pickup time to the customer's paging device 111, mobile phone 12, or Chinese language pager 14 through a terminal receiving/transmitting interface 33 or a multi-frequency phone receiving/transmitting interface (DTMF TX) 35. Then, the taxi driver will turn on the meter after the pickup of passenger and the electronic map 321 of said service center then instantly react and indicate that said taxi is occupied. After being notified with the destination, the taxi driver can use a satellite navigator 21 or 326 to calculate the preferred driving route and estimated arrival time, while said service center will automatically record the locations and times of pickup and drop-off in a file.

Further, the taxi driver can receive through a FM sub-carrier receiver 23 real time traffic information transmitted from a FM broadcasting station 4 or a taxi service center 3. At the same time, said taxi service center 3 can use a satellite track-tracing route record preserving device 325 to record and save as a file for each taxi on information such as traveling route and pickup/drop-off location for each day and for each service. The taxi driver can also use a satellite positioning track-tracing recorder 22 to record and save as a file for information such as traveling route.

Moreover, the customer can use a device such as paging device 111 to call for a specific acquainted taxi driver through a taxi service center 3.

Therefore, as described above, the present invention can effectively prevent taxi-related crime and provide the police with help of tracing and investigating a possible crime case.

It is understood that present invention is not limited to above description and is allowed to have various modifications and changes, however, the present invention will consider them as equivalent in meaning and domain of attached claims.

DESCRIPTION OF SYMBOL

1 customer-side setup
11 phone set
12 mobile phone
13 public phone
14 Chinese language pager
111 paging device
121 intelligent card (suitable for mobile phone)
131 pre-paid card (suitable for public phone)
141 Chinese language pager or sub-carrier receiver
2 taxi
21 satellite positioning vehicle navigator
22 satellite positioning track-tracing recorder
23 FM (Frequency Modulation) sub-carrier receiver
24 taxi station radio transmitter
25 mobile communication device
26 vehicle robbery-prevention security device
3 taxi service center
31 CPU
32 system synthetic interface
33 terminal receiving/transmitting interface
34 multi-frequency phone receiving interface
35 multi-frequency phone transmitting interface
321 electronic map search for nearby vacant taxi (red: occupied green: vacant blue: off-duty)
321 ' customer's message
322 taxi-driver confirming device (model/registration number/arrival time are sent to control center and customer's mobile phone or Chinese language pager/receiver respectively)
323 FM sub-carrier transmitter that provide traffic information
324 satellite positioning vehicle monitoring device
325 satellite track-tracing route record preserving device
326 satellite navigator that leads to nearest route
4 FM broadcasting station
41 schedule arrangement operating device
42 FM sub-carrier modulator
43 FM sub-carrier transmitting station

What I claimed is:

1. In an intelligent taxi total service system, a method for providing taxi service for a customer at either a stationary residence or a non-stationary location, comprising the steps of:

a) the customer sending a message over a phone line by pushing a button on an exclusive paging device provided by a taxi service center so as to display basic information, including at least one of name or identification number, address and phone number, on a computer monitor of said taxi service center, through a satellite navigation system, a directing management means showing the status of nearby subordinate taxis, in which a red symbol indicates occupied, a blue symbol indicates off-duty, and a green indicates vacant;

b) converting said message into readable language by an automatic editing decode function of said directing management means and broadcasting through an FM sub-carrier transmitting station, so as to display said message on an LCD display screen in said subordinate taxis to ask for a taxi that is willing to pickup the customer, upon receiving the response from a taxi, sending the responding taxi's basic information, including registration number and model of the vehicle and driver's name, as well as a pickup time to the paging device on the customer-side through a cable or a radio transmitting system by means of said directing management means;

c) turning on a meter in the taxi by the driver after pickup of the customer whereby an electronic map of said service center then immediately reacts to indicate that said taxi is occupied;

d) the taxi driver calculating a preferred driving route and an estimated arrival time by use of a satellite navigation function upon being notified by the customer of the destination;

e) said service center recording the location and time of pickup and drop-off in a file;

f) said service center storing the operation track of all its subordinate taxis;

g) the taxi driver printing a receipt for the customer at drop-off, at the same time said service center indicating said taxi as vacant; and h) the taxi driver pushing an off-duty button so as to display an off-duty status on the computer monitor of said taxi service center at the time the taxi driver is off-duty.

2. In an intelligent taxi total service system a method for providing taxi service for a customer having a mobile phone, comprising the steps of:

a) the customer sending a message to a taxi service center through a mobile phone by use of an intelligent card to display basic information, including at least one of name or identification number, address and phone number, on a computer monitor of said taxi service center, said taxi service center searching for a currently available taxi nearby through a satellite navigation system;

b) converting said message into readable language by an automatic editing decode function of a directing management means which shows the status of nearby subordinate taxis, and broadcasting through an FM sub-carrier transmitting station, so as to display said message on an LCD display screen in said taxis to ask for a taxi that is willing to pickup the customer, upon receiving the response from a taxi, said directing management means sending the responding taxi's basic information, including registration number and model of the vehicle and driver's name, as well as a pickup time to the customer's mobile phone through a voice mail or a message;

c) turning on a meter in the taxi by the driver after pickup of the customer whereby an electronic map of said service center then immediately reacts to indicate that said taxi is occupied;

d) the driver calculating a preferred driving route and an estimated arrival time by use of a satellite navigation function upon being notified by the customer of the destination;

e) said service center recording the location and time of pickup and drop-off in a file;

f) said service center storing the operation track of all its subordinate taxis;

g) the taxi driver printing a receipt for the customer at drop-off, at the same time said service center indicating said taxi as vacant; and h) the taxi driver pushing an off-duty button so as to display an off-duty status on the computer monitor of said service center at the time the taxi driver is off-duty.

3. In an intelligent taxi total service system a method for providing taxi service for a customer having a pager, comprising the steps of:

a) the customer placing a toll free telephone call through a public phone by using an intelligent card and following the voice instruction to display basic information, including at least one of name or identification number, address and phone number, on a computer monitor of a taxi service center, said taxi service center searching for a currently available taxi nearby through a satellite navigation system;

b) converting said message into readable language by an automatic editing decode function of a directing management means, and broadcasting through an FM sub-carrier transmitting station so as to display said message on an LCD display screen in taxis to ask for a taxi that is willing to pickup the customer, upon receiving the response from a taxi, said directing management means sending the responding taxi's basic information, including registration number and model of the vehicle and driver's name, as well as a pickup time to the customer's pager through a voice mail or a message;

c) turning on a meter in the taxi by the driver after pickup of the customer whereby an electronic map of said service center then immediately reacts to indicate that said taxi is occupied;

d) the taxi driver calculating a preferred driving route and an estimated arrival time by use of a satellite navigation function upon being notified by the customer of the destination;

e) said service center recording the location and time of pickup and drop-off in a file;

f) said service center storing the operation track of all its subordinate taxis;

g) the taxi driver printing a receipt for the customer at drop-off, at the same time said service center indicating said taxi as vacant; and h) the taxi driver pushing an off-duty button to display an off-duty status on the computer monitor of said service center at the time the taxi driver is off-duty.

* * * * *